US005283970A

United States Patent [19]

Aigner

[11] Patent Number: 5,283,970

[45] Date of Patent: Feb. 8, 1994

[54] TOY GUNS

[75] Inventor: Gary D. Aigner, Chicago, Ill.

[73] Assignee: Strombecker Corporation, Chicago, Ill.

[21] Appl. No.: 951,213

[22] Filed: Sep. 25, 1992

[51] Int. Cl.[5] ..... F41C 3/06; A63H 5/04

[52] U.S. Cl. ..... 42/57; 362/112; 446/406

[58] Field of Search ..... 89/9, 12; 42/54, 57; 446/401, 405–407, 473; 362/110, 112–114

[56] References Cited

U.S. PATENT DOCUMENTS

| | | | |
|---|---|---|---|
| 1,328,230 | 1/1920 | Johnston | 89/12 |
| 2,660,000 | 11/1953 | Strayer | 362/112 |
| 3,266,183 | 8/1966 | Tada | 42/57 |
| 3,355,834 | 12/1967 | Tada | 42/57 |
| 4,259,891 | 4/1981 | Rosenzweig | 89/12 |
| 4,750,641 | 6/1988 | Chin-Fu | 446/406 |
| 4,808,143 | 2/1989 | Kuo | 446/473 |
| 4,841,835 | 6/1989 | Bohler et al. | 89/12 |
| 4,934,244 | 6/1990 | Johnson | 89/12 |
| 5,004,444 | 4/1991 | Chih | 446/406 |
| 5,059,150 | 10/1991 | Kuo | 446/405 |

*Primary Examiner*—David H. Brown

*Attorney, Agent, or Firm*—Jones, Day, Reavis & Pogue

[57] ABSTRACT

Toy guns are disclosed which are capable of simultaneously generating light and sound effects, having rotating a barrel assembly, creating vibrations in the body of the toy gun and operating a rapid indexing and cap firing mechanism. The rotating barrels, the cap indexing and firing mechanism and the vibration mechanism are all driven from a motor-driven gear and shaft assembly positioned within the toy gun. A dual action trigger is used to energize the light and sound effects when the trigger is activated to make a first electrical contact. Upon further activation, the trigger makes a second electrical contact which powers the motor and the gear and shaft assembly to drive the rotating barrel assembly, the cap indexing and firing mechanism and the vibration mechanism, as the light and sound effects continue.

12 Claims, 4 Drawing Sheets

TOY GUNS

BACKGROUND OF THE INVENTION

1. Field of the Invention

The present invention relates to toy guns. More particularly, the invention relates to toy guns incorporating a variety of special effects simulating the operation of an automatic or semi-automatic submachine gun such as a gatling gun and which are constructed in a more efficient and cost-effective manner than prior toy guns.

2. Description of Related Art

Toy guns have been known heretofore which exhibit certain special effects. Light and sound effects, barrel recoil, muzzle flashes, vibration effects and cap firing mechanisms individually and in limited combinations have all been used in toy guns to simulate real guns and/or to create fantasy effects thus enhancing the appeal of the toy guns to consumers.

For example, U.S. Pat. No. 5,059,150 to Kuo discloses a vibrating and sonic device for a toy gun installed within a chamber of a toy gun body. The vibrating and sonic device therein includes a motor-driven mechanism operated by pulling a trigger. A shaking effect is imparted to the gun by the movement of an eccentric cam by a motor powered by batteries. The eccentric mechanism, lights and sound effects are controlled using solid state circuitry.

U.S. Pat. No. 4,808,143 to Kuo discloses a toy gun including a trigger associated with a micro-switch. The micro-switch engages a rotatable wheel through a reduction gear. A link assembly, together with a rotatable wheel, provides a reciprocating motion and creates a kick-back effect. In addition, the link assembly is arranged to actuate another micro-switch which controls an audio circuit board and a speaker for generating a sound which mimics a gunshot.

U.S. Pat. No. 3,094,110 to Ryan discloses a toy gun which simulates an automatic rifle or portable machine gun. The invention utilizes a rocker which is operatively associated with a rack, so that linear motion of the rack imparts a rocking or oscillating motion to the rocker. The toy gun also contains a clapper device, a cap firing device, missile expelling means or other means, individually or in combination, operatively associated with the rocker.

U.S. Pat. No. 5,004,444 to Chih discloses a toy submachine gun which includes a body housing having a magazine housing and a pistol grip, a trigger, a plate spring and a contact engageable by the plate spring. When the trigger is squeezed, a motor drives a rotating arm through a reduction gear assembly. The rotating arm has an eccentric shaft reciprocatingly guided within a groove provided in the body housing. A striking plate spring also engages with the rotating arm so that then it is released therefrom it will strike a sound box. The reduction gear assembly, the rotating arm, the sound box and the striking plate spring are mounted in the casing so as to provide an enhanced vibrating feeling to the user of the gun by the reciprocal motion of the barrel casing.

Other patents of general interest are U.S. Pat. No. 4,750,641 to Chia-Fu, "Continuous Water-Ejecting Pistol Toy With Simultaneous Sound and Red-Flash Effects", U.S. Pat. No. 4,239,129 to Espisito, "Water Pistol And/Or Flash Light Structure", U.S. Pat. No. 2,741,872 to Sigg, "Multiple Action Toy Gun".

In addition, commercially available toy gun products demonstrating certain special effects include the "24001 Pulsator" gun sold by DSI which exhibits pulsating light effects, eight different sound effects and vibration effects. The "2300 Command Force" by SRM has a recoiling barrel, flashing light and sound effects. The "23015 Combat Force 0.50" by DSI has machine gun sound effects, barrel recoil, muzzle flash, a removable ammunition clip and a detachable tri-pod stand. The "Eliminator" by Tootsietoy six different realistic sound effects and two different fantasy sound effects, chaing barrel lights, strip cap firing, adjustable stock and removable ammunition clip.

Such prior toy guns, however, have not fully satisfied the consumer's quest for new and improved toy weapons exhibiting unique and distinctive features separately and in combination. For example, prior toy guns have not incorporated rotating barrels to simulate the action of an automatic or semi-automatic multiple barrel gatling gun-type construction as is provided herein.

Another problem with prior toy gun products which provide a diversity of special effects in operation is that they require relatively complex and bulky mechanisms to enable the achievement of each of the separate and combined effects. Thus, only a few effects have been incorporated in each prior construction as a result of the inherent inefficiencies of production and the accompanying costs of incorporating these special effects into prior toy gun products as well as the bulky dimensions which would result from the incorporation of a multiplicity of special effects into such products.

SUMMARY OF THE INVENTION

Therefore, it is an object of the present invention to provide toy guns that display a wide variety of realistic special effects and are more stimulating to a child.

It is a further object of the present invention to provide toy guns which simulate the operation of automatic or semi-automatic submachine guns and, in particular, have motorized rotating barrels simulating a gatling gun construction.

Another object of the present invention is to provide toy guns which are less costly to produce and more efficient in operation as a result of their use of motor driven special effects utilizing a single motor and a single common gear and shaft assembly to operate the mechanical effects, and which combine multiple special effects in order to achieve a realistic simulation of an operative submachine gun.

A still further object is to provide toy gun products which exhibit a wide variety of special features and effects including lighting effects, sound effects, vibratory action, cap firing, rotating barrel arrangements wherein all of the mechanical devices including a vibration mechanism, a cap indexing and firing mechanism and a rotating barrel drive mechanism are actuated with improved efficiency and at a reduced manufacturing cost utilizing a single motor driven gear and shaft assembly. This construction allows for a simplified arrangement of parts and achieves an improved synchronization of the various combined special effects with a minimum of parts and expenses.

Thus, the present invention relates to toy guns configured to simulate automatic or semi-automatic gatling gun-type submachine guns having a trigger mechanism therein for actuating light and sound effects and a motor-driven gear and shaft assembly which activates rotatingly mounted gun barrels to simulate a gatling gun operational effect. The motor-driven gear and shaft assembly also causes operation of an eccentric counter-weight mechanism for achieving vibratory effects in the guns and further causes operation of a cap indexing and firing mechanism to provide a cap firing capability in the toy guns.

In operation of a preferred embodiment of the toy guns of this invention, when the trigger is squeezed to a first actuation point, an electrical contact is made which energizes lights and synthesized sound effects in the toy gun. Thereafter, as the trigger is fully actuated, the light and sound effects continue, and a motorized gear and shaft assembly is powered to rotate a simulated multiple gun barrel arrangement and to rotate an eccentric counter-weight within the housing so as to create a vibratory action of the toy gun as well as to drive a motorized cap indexing and firing mechanism whereby a roll of explosive caps is fired simultaneously with the other actions in process. The total effect achieved is to simulate the operation of a real gatling-type gun with lights, sound, rotating barrels, vibration and rapid cap firing.

BRIEF DESCRIPTION OF THE DRAWINGS

The features, objects and advantages of the present invention will be better understood when the following detailed description is read in light of the drawings appended hereto in which like numerals represent like elements and in which.

DETAILED DESCRIPTION OF THE PREFERRED EMBODIMENTS

Figure 1:
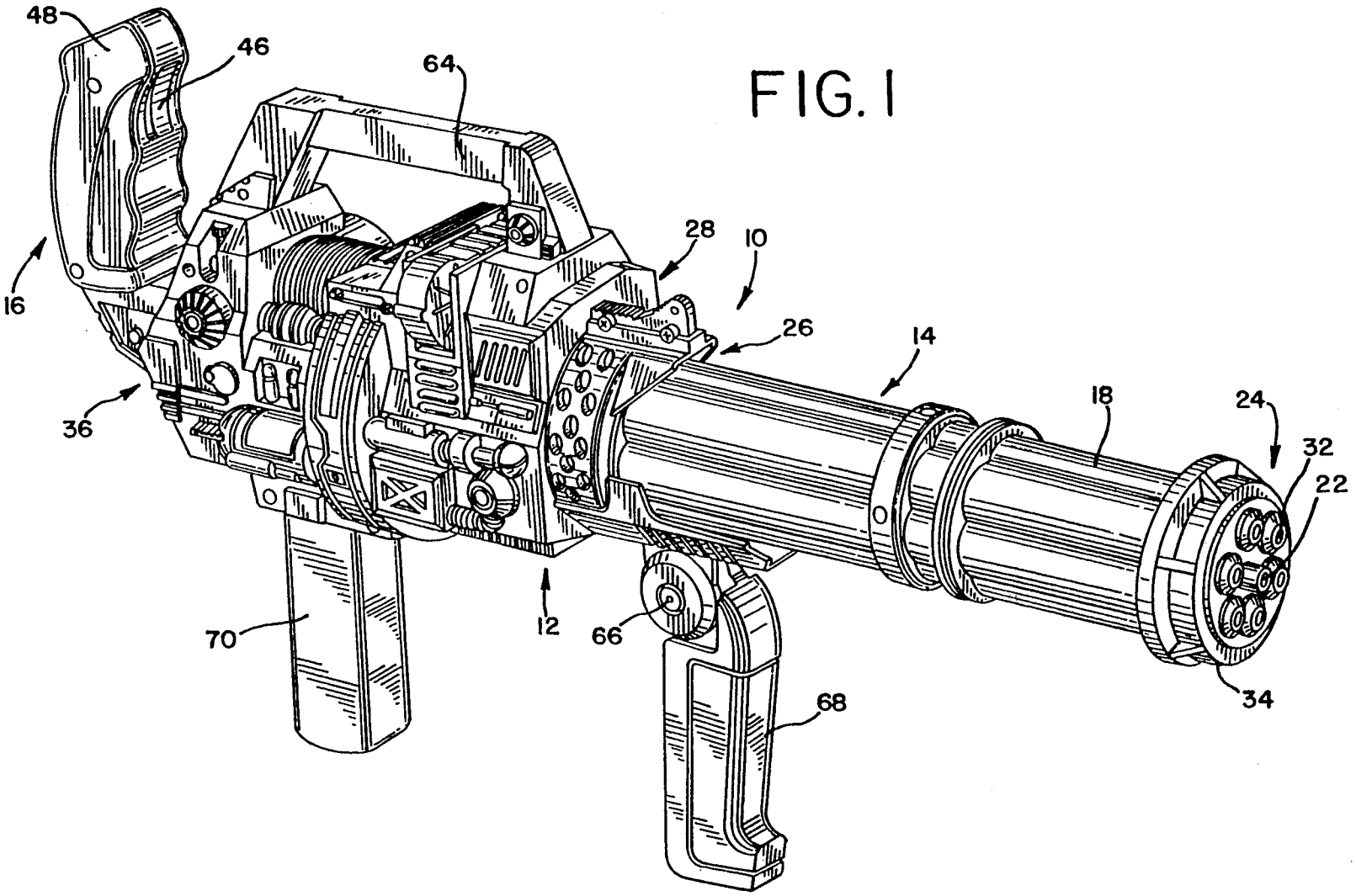
FIG. 1 is a perspective view showing a toy gun according to the present invention.
Figure 2:
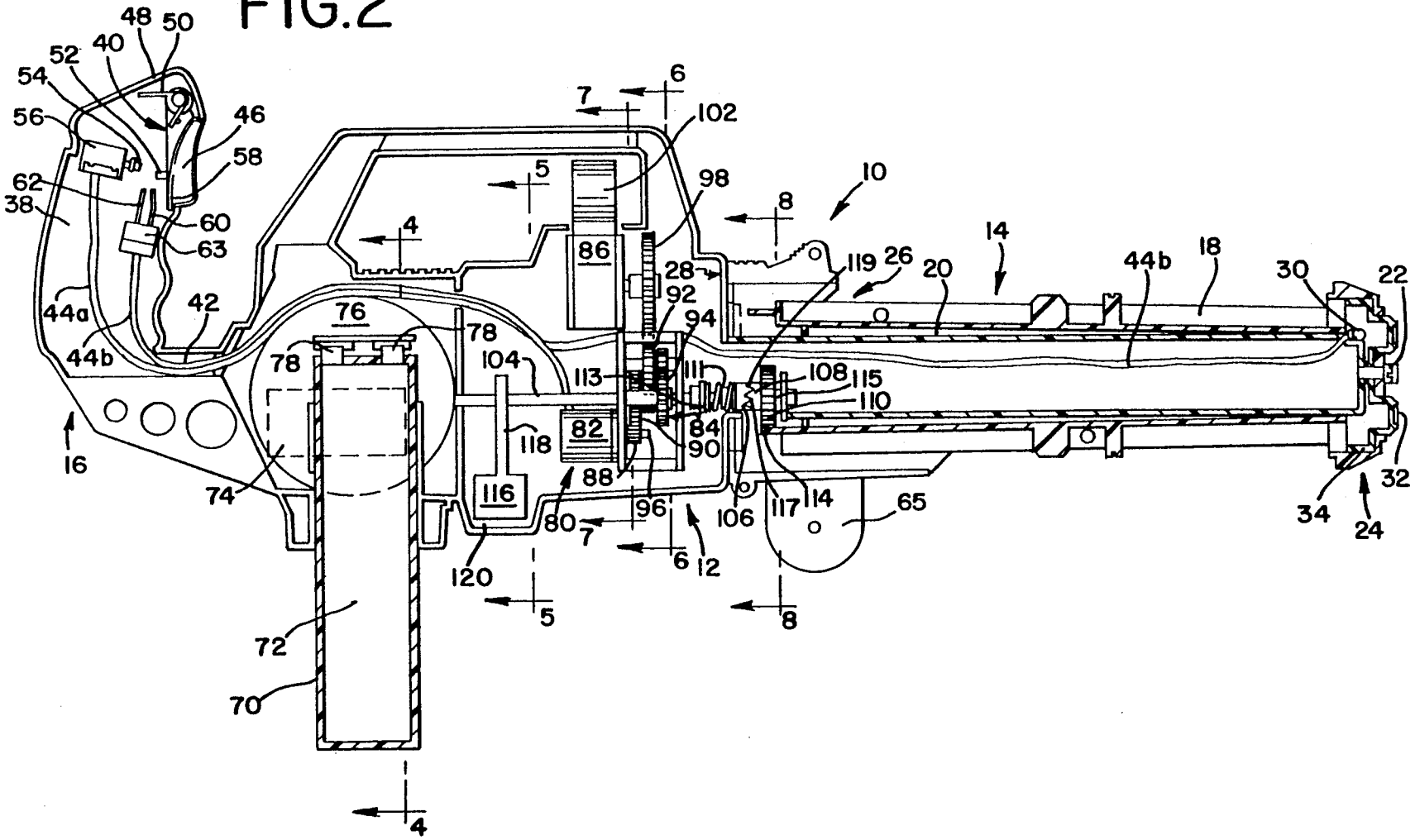
FIG. 2 is a longitudinal elevational section of the toy gun of FIG. 1.
Figure 3:
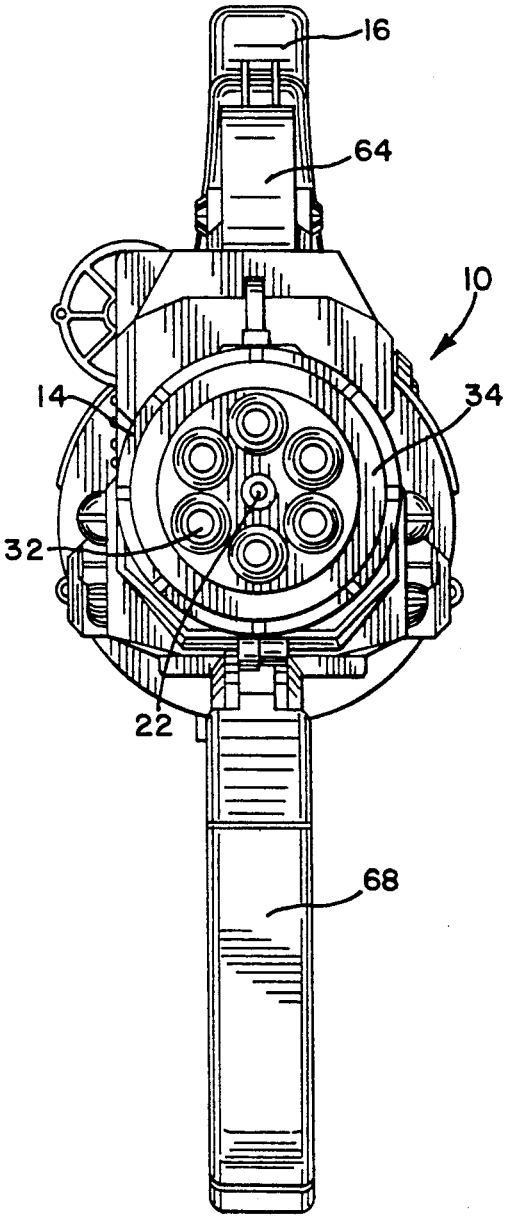
FIG. 3 is a front end elevational view showing the arrangement at the barrel discharge end of the toy gun of FIG. 1 for providing lighting effects therein.

Observing initially FIGS. 1-3 of the drawings, there is illustrated a preferred embodiment of the toy guns of the present invention, generally designated by the numeral 10. As shown from the Figures, toy gun 10 is generally configured in the shape of a gatling gun having a main housing 12 with a barrel assembly 14 anteriorly mounted thereto and extending longitudinally outwardly therefrom. A grip assembly 16 extending outwardly from housing 12 in an opposite longitudinal direction extending from the posterior end of the housing.

Barrel assembly 14 includes a cylindrical outer shell member 18 shaped to simulate a clustered multiple barrel arrangement as would be exhibited in the external appearance of a real gatling gun construction. However, it is to be understood that shell 18 in the toy guns of the present invention may be formed with any desired number or shape of barrels including a single cylindrical barrel shape.

A barrel mounting sleeve 20 is positioned coaxially within the barrel shell 18 and extends longitudinally essentially the same distance as the outer shell 18. Shell 18 is affixed to sleeve 20 via a screw fastening arrangement 22 at the distal or discharge end 24 of the barrel assembly 14 and sleeve 20 is mounted at its proximal end 26 to a forward facing end 28 of housing 12 in a manner to be described hereinafter such that the barrel assembly 14 including both shell 18 and sleeve 20 is rotatable relative to the housing 12. An illuminating device such as light bulb 30 is mounted on sleeve 20 adjacent distal end 24 thereof in a manner such that when light 30 is illuminated a visual effect can be detected through slots 32 formed in light screen or cover 34 which is affixed to the barrel assembly 14 at its distal end 24 via fastener 22.

Grip assembly 16 is integrally formed on the rearward facing end 36 of housing 12 and is constructed with a hollowed out section 38 to accommodate a trigger mechanism 40. A passageway 42 leads from the hollow section 38 of the grip assembly 16 to housing 12 and accommodates electrical wiring 44*a* and 44*b* extending from trigger mechanism 40 housed within grip assembly 16 into main housing 12. The trigger mechanism 40 includes a trigger element 46 which projects outwardly through casing 48 of grip assembly 16 to enable finger actuation thereof by a user of the toy gun 10.

The trigger 46 is biased outwardly by a spring 50 to maintain the gun 10 in a normally inoperative condition so that as the trigger 46 is squeezed inwardly against the action of spring 50, a trigger knob 52 projecting from the rear surface of trigger 46 is moved into abuttment with an electrical effects actuator 54. Then, as trigger 46 is squeezed further inwardly of hollow section 38, electrical effects actuator 54 is pushed to a contact point (not shown) within electrical effects switch box 56 which energizes electrical circuitry to be detailed hereinafter via wiring 44*a* causing a first set of electrically oriented special effects to be actuated including illumination of light 30 and initiation of various sound effects.

Upon further inward squeezing of the trigger 46, section 58 of trigger 46 encounters plate spring 60 and urges spring 60 into contact with motor drive contact member 62 of motor drive switch 63 completing another electrical circuit via wiring 44*b* which actuates a second set of special effects which will be detailed hereinafter in reference to the operation of the gun 10.

Figure 4:
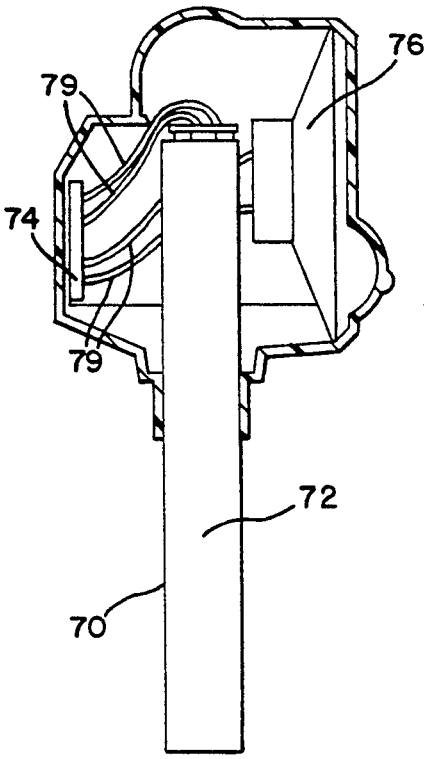
FIG. 4 is a sectional view taken along line 4—4 in FIG. 2 showing a battery pack casing for housing a battery to be used to powder the operation of the toy gun; a circuit board for providing sound effects in the toy gun and a speaker for amplifying and broadcasting such sound effects.

Housing 12 includes a carry handle 64 and a hinge mounting plate 66 for interconnection with a retractable gun gripping armature 68 positioned on its lower external surface. Also, a battery pack 70 which is configured to accommodate a battery 72 is detachably interconnected with housing 12 and battery 72 is in electrical contact with circuit board 7 and audio speaker 76 within housing 12 via contacts 78 and wiring 79 as best illustrated in FIG. 4. Circuit board 74 includes a commercially available chip which provides appropriate gun firing and other sound effects which are amplified and broadcast through speaker 7 when activated by operation of trigger 46 acting on electrical effects activator 54 and completing a electrical circuit through battery 72 and wiring 79.

Housing 12 further contains a motor assembly 80 which is activated by the further operation of trigger 46 acting o spring 60 and motor drive contact member 62 of motor drive switch 63 to complete another electrical circuit through battery 72.

Figure 6:
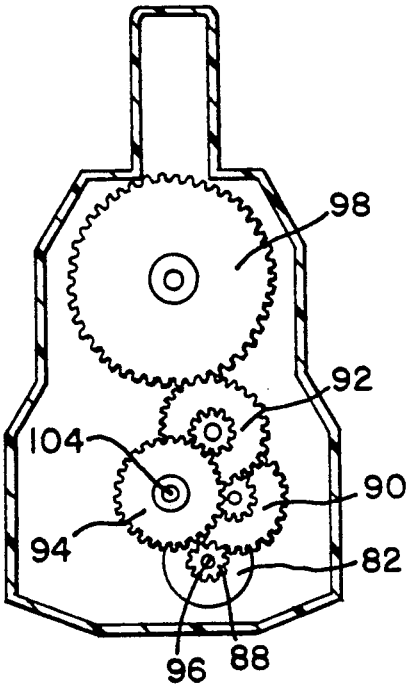
FIG. 6 is an elevation view looking rearwardly from a sectional plane taken along line 6—6 in FIG. 2 showing the drive gear train of the toy gun which is employed to cause operation of a cap indexing and firing mechanism and for rotating the toy gun barrel.
Figure 7:
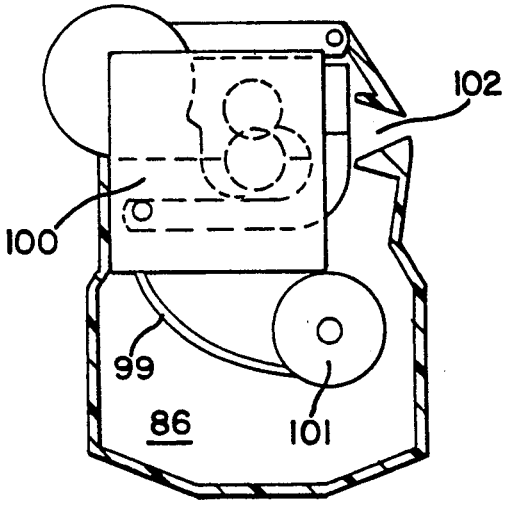
FIG. 7 is a sectional view taken along line 7—7 in FIG. 2 showing the cap indexing and firing mechanism of the toy gun.

Motor assembly 80 includes a motor 82 and a gear and shaft assembly 84 (best illustrated in FIGS. 2 and 6) driven by motor 82 which causes rotation of the barrel assembly 14 as well as operation of cap mechanism 86. More specifically, the drive gear and shaft assembly 84 comprises an intermeshing set of reduction gears 88, 90, 92 and 94 arranged in a manner such that gear 88 mounted on a shaft 96 extending outwardly from motor 82 drives gear 90 which in turn drives gear 92. Gear 92 is operatively intermeshed with cap indexing and firing gear 98 so that as gear 92 rotates as a result of the operation of drive gear and shaft assembly 84, gear 98 rotates thereby causing cap indexing and firing mechanism 100 (best illustrated in FIG. 7) to operate.

Thus, by rotational movement of shaft 96 from motor 82 causing the gears in gear and shaft assembly 84 to rotate and drive gear 98, caps 99 are indexed from a roll of caps 101 inserted in the cap indexing and firing mechanism 100 and are fired by such mechanism. Thereafter, spent caps are indexed out of the cap firing mechanism 100 and are released from the gun 10 through spent cap discharge 102. Cap indexing and firing mechanisms suitable for use herein are known and are commercially available.

Figure 5:
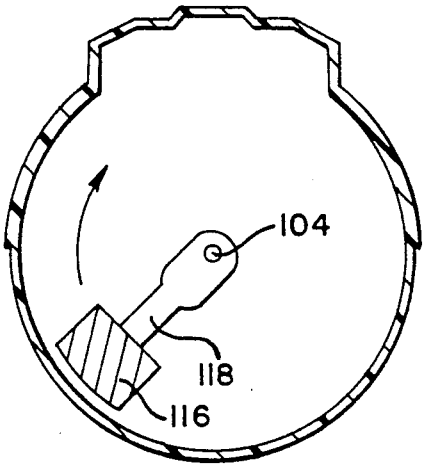
FIG. 5 is a sectional view taken along line 5—5 in FIG. 2 showing the eccentric cam arrangement in the structure of the toy gun for causing vibration thereof.
Figure 8:
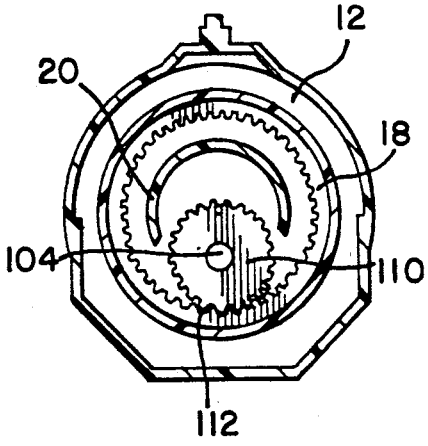
FIG. 8 is a sectional view taken along line 8—8 in FIG. 2 showing the barrel rotational drive mechanism of the toy gun.

In addition to causing operation of the cap indexing and firing mechanism 100, drive shaft 96 from motor 82 simultaneously causes operation of two further special effects within the capabilities of the present toy gun 10 via operation of gear and shaft assembly 84. That is, drive shaft 96 drives gears 88, 90 and 92 as detailed above and gear 92 is operatively intermeshed with gear 94 which is mounted on drive shaft 104 so that rotational motion is imparted to shaft 104 through operation of drive gear and shaft assembly 84. Rotating shaft 104, rotatingly in turn, drives a ratchet faced clutch 106 which is mounted for reciprocal, longitudinal motion on shaft 104. The clutch 106 is biased into engagement with ratchet faced gear 108 on ring gear 110 via a coil spring 111 interposed between a stop member 113 fixedly mounted on drive shaft 104 and clutch 106. Ratchet faced gear 108 and ring gear 110 are mounted on shaft 104 in the same manner as clutch 106 so that they are rotatingly driven by drive shaft 104 and are capable of reciprocal, longitudinal movement along shaft 104 between stop member 113 at one end and stop member 115 which is fixedly mounted on shaft 104 at the other end. Thus, the rotational movement of shaft 104 results in rotational movement of ring gear 110 which causes rotation of barrel assembly 14 by intermeshing action of gear 110 with teeth 112 formed about the inner circumference of mounting sleeve 20 of barrel assembly 14 (best illustrated in FIG. 8) which is rotatingly mounted to housing 12 via mounting bracket 114 formed on the anterior or front end 28 of housing 12. However, as a safety feature of the toy guns herein, if a user of the device should grasp the barrel 14 in a manner that a force is applied in an attempt to stop the motor driven rotational force of the barrel during operation or to apply a rotational force in a direction opposite the normal direction of rotation of the barrel 14, the stopping or counter directed rotational force on the barrel 14 applied by the user will cause a twisting force to be applied in the counter direction to ring gear 110 via intermeshed teeth 112 on the interior of barrel 14. This twisting force will cause the teeth 117 on gear 108 to disengage from nesting relationship with teeth 119 on clutch 106 as illustrated in FIG. 2 and will cause the teeth 117 to rotate over the surface of teeth 119 forcing the clutch 106 acting as a cam follower to move in an undulating manner. That is, the clutch 106 will move in a disengaging direction rearwardly against the biasing action of spring 111 when the teeth 117 of gear 108 on ring gear 110 rotate to a position in which the teeth 117 contact an upper section of teeth 119 and the clutch 106 will move forwardly into meshed engagement with gear 108 under the biasing influence of spring 111 as the teeth 117 rotate to a position in which the teeth 117 are in mating relationship with teeth 119. Also, as best illustrated in FIGS. 2 and 5, rotating drive shaft 104 simultaneously causes eccentric weight 116 on arm 118 to rotate in a groove or slot 120 formed in housing 12 causing toy gun 10 to vibrate in a manner such that the operation of a real gatling gun is simulated in regard to the vibratory action of a shooting gun.

Thus, the operation of the present toy gun is initiated when trigger 46 is squeezed so as to close the contact in electrical effects switch box 56 and complete an electrical circuit energized by battery 72 in casing 70 through contacts 78 by linking electrical effects actuator 54 with circuit board 74 and with barrel light bulb 30 via wiring 44*a*. This electrical connection causes sound effects to be emitted from the gun 10 through audio speaker 76 and for illumination effects to be exhibited by gun 10 as light emitted by bulb 30 is viewed through slots 32 in light screen 34 at the distal end 24 of barrel assembly 14.

Thereafter, as trigger 46 is squeezed further, the light and sound effects continue and the contacts 60 and 62 of motor drive switch 63 are closed energizing motor 82 through battery 72. Motor 82 operating through an intermeshing gear set 84 rotates drive shaft 104 to drive the ratchet faced clutch 106, ratchet faced gear 108 and ring gear 110 causing barrel assembly 14 to rotate. Operation of this motor-gear arrangement also causes cap indexing and firing gear 98 to drive cap indexing and firing mechanism 100 and further causes rotating arm 118 carrying eccentric weight 116 to rotate about common drive shaft 104 resulting in a vibrating action being imparted as the toy gun 10 operates.

The result of all of the special effects is to create a toy gun which at full operation of all special effects has a rotating barrel 14 appearing to be firing by virtue of barrel light bulb 30 as seen through bulb cover 34 while firing caps from a cap roll at a high rate of indexing, and in which vibrations are transmitted through the gun by virtue of the eccentric weight 116 rotating about common drive shaft 104 and having special audio effects broadcast through speaker 76.

The foregoing specification describes only the embodiments of the invention shown and/or described. Other embodiments may be articulated as well. The terms and expressions used, therefore, serve only to describe the invention by example and not to limit the invention. It is expected that others will perceive differences which, while different from the foregoing, do not depart from the scope of the invention herein described and claimed. In particular, any of the specific constructional elements described may be replaced by any element having equivalent function.

I claim:

1. A toy gun comprising:

a housing having a fixedly attached grip assembly and a rotatingly mounted barrel assembly interconnected therewith at opposed ends of said housing;

a trigger mechanism movably connected to said grip assembly;

a first contact means engageable by said trigger mechanism to actuate a first set of operating conditions in said toy gun;

a second contact means engageable by said trigger mechanism to actuate a second set of operating conditions in said toy gun;

said first set of operating conditions including light effects resulting from illumination of a light emitting means positioned in said barrel assembly and sound effects resulting from activation of a speaker assembly positioned in said housing; and said second set of operating conditions including rotation of said barrel assembly.

2. The toy gun according to claim 1 wherein said trigger mechanism includes:

a trigger element extending outwardly from said grip assembly to enable finger actuation thereof;

means for biasing said trigger element outwardly in a normally inoperative condition;

first operating means associated with said trigger element for engagement with said first contact means for actuation of said first set of conditions as the trigger element is moved a partial distance inwardly against the force of the biasing means; and second operating means associated with said trigger element for engagement with said second contact means for actuation of said second set of conditions as the trigger element is moved further inwardly from said partial distance.

3. The toy gun according to claim 2 comprising:

a motor assembly including a motor and a gear and shaft assembly driven by said motor;

said motor being operatively interconnected with said second contact means in a manner such that as said second operating means engages said second contact means, said shaft of said gear and shaft assembly is caused to rotate; and said gear and shaft assembly is operatively interconnected with said barrel assembly in a manner such that as said shaft rotates, it causes said barrel assembly to rotate.

4. The toy gun of claim 3 wherein said gear and shaft assembly intermeshes with engagement means formed on an inner surface of said barrel assembly to cause said rotation of said barrel assembly.

5. The toy gun of claim 3 wherein said second set of operating conditions includes vibration of said housing caused by rotational movement of an eccentric weight armature assembly positioned in said housing and operatively interconnected with said shaft of said gear and shaft assembly so as to rotate as said shaft rotates.

6. The toy gun of claim 5 wherein said second set of operating conditions includes explosive cap firing caused by firing assembly positioned in said housing and operatively interconnected with said gear and shaft assembly so as to operate when said gear and shaft assembly is actuated.

7. The toy gun of claim 6 wherein said first and said second operating conditions are actuated simultaneously.

8. A toy gun comprising:

a housing having a grip assembly connected to said housing at one end and a barrel assembly rotatably mounted to said housing at the other end;

a motor mounted in said housing;

a trigger mechanism mounted in said grip assembly electrically connected to said motor in a manner such that said motor is energized when said trigger mechanism is actuated;

a gear and shaft assembly driven by said motor for rotating said barrel assembly of said housing;

said gear and shaft assembly including an extension shaft engaged with a gear mechanism in a manner such that rotation of said extension shaft causes said gear mechanism to rotate; and said barrel assembly having means formed on an inner surface thereof for engagement with said gear mechanism in a manner such that rotation of said gear mechanism causes said barrel assembly to rotate.

9. A toy gun comprising:

a housing having a grip assembly connected to said housing at one end and a barrel assembly rotatably mounted to said housing at the other end;

a motor mounted in said housing;

a trigger mechanism mounted in said grip assembly electrically connected to said motor in a manner such that said motor is energized when said trigger mechanism is actuated;

a gear and shaft assembly driven by said motor for rotating said barrel assembly of said housing; and a mechanism for causing said housing to vibrate upon operation of said toy gun.

10. The toy gun according to claim 9 wherein said mechanism for causing said housing to vibrate includes a rotating arm driven by said shaft of said motor driven gear and shaft assembly and having an eccentric weight mounted on said rotating arm for rotation within said housing.

11. A toy gun comprising:

a housing having a grip assembly connected to said housing at one end and a barrel assembly rotatably mounted to said housing at the other end;

a motor mounted in said housing;

a trigger mechanism mounted in said grip assembly electrically connected to said motor in a manner such that said motor is energized when said trigger mechanism is actuated;

a gear and shaft assembly driven by said motor for rotating said barrel assembly of said housing; and a mechanism for indexing and firing explosive caps driven by said gear and shaft assembly.

12. A toy gun comprising:

a housing having a grip assembly connected to said housing at one end and a barrel assembly rotatably mounted to said housing at the other end;

a motor mounted in said housing;

a trigger mechanism mounted in said grip assembly electrically connected to said motor in a manner such that said motor is energized when said trigger mechanism is actuated;

a gear and shaft assembly driven by said motor for rotating said barrel assembly of said housing; and means for creating and transmitting vibrations in said housing;

means for indexing and firing explosive caps;

means for actuating a light emitting device;

means for transmitting sound effects through a speaker positioned in said housing; and electrical circuit means causing said light emitting device and said means for transmitting sound effects to be energized through an electrical connection which is made when said trigger mechanism is actuated whereby said light and sound are energized along with said motor for rotating said barrel assembly.

* * * * *